US005135233A

United States Patent [19]

Leas et al.

[11] Patent Number: 5,135,233

[45] Date of Patent: Aug. 4, 1992

[54] PENDULUM TOY

[76] Inventors: James M. Leas; Sandra F. C. Leas; Zoe J. Leas, all of 17 Calarco Ct., Burlington, Vt. 05401

[21] Appl. No.: 624,342

[22] Filed: Nov. 29, 1990

[51] Int. Cl.[5] ..... A63B 67/10; A63H 33/08

[52] U.S. Cl. ..... 273/413; 273/58 G; 446/121

[58] Field of Search ..... 273/413, 58 C; 446/120, 446/121

[56] References Cited

U.S. PATENT DOCUMENTS 2,662,335 12/1953 Calverley ..... 446/120 X
3,192,738 7/1965 Charles et al. ..... 446/121 X
3,776,551 12/1973 Schaller et al. ..... 273/413

*Primary Examiner*—William H. Grieb
*Attorney, Agent, or Firm*—James M. Leas

[57] ABSTRACT

The present invention provides an apparatus and method for safely playing a catching, hitting, or throwing game with an infant or disabled adult. The object to be caught, hit, or thrown is made the base of a pendulum and the object is caught, hit, or thrown near the most elevated position/location of the arc of the pendulum, at which the object comes to rest and where it is therefore easiest to catch, hit, or throw. Means are included to avoid hazards of hanging, strangling, choking, and contusions.

9 Claims, 6 Drawing Sheets

PENDULUM TOY

BACKGROUND OF THE INVENTION

This invention generally relates to toys and more particularly to a pendulum apparatus and method that enable a child 4 months old or older to catch and to throw or otherwise impart energy to a ball, doll, or other object with such control that another person can play a catch game with the child.

If an object is thrown or rolled toward a small infant or toddler, the baby will not normally be able to react quickly enough to catch it. Children are normally several years old before they can particulate in catching or throwing a ball with a partner. This is because most of the kinetic energy imparted to the thrown object remains with the object during its trajectory and even a gently thrown object is travelling 10 feet per second or more. Thus, the catcher has a very short time to intercept the object. She must also absorb all the kinetic energy of the object to keep hold of it.

This invention allows much younger babies to enjoy catching, throwing, and hitting and to develop hand-eye coordination and motor skills associated with such play by taking advantage of the fact that in a pendulum all of the kinetic energy is converted into potential energy at the ends of the arc. In other words, the pendulum is at rest at each end of its swing. Thus, a catcher located at the end of the arc has much more time to react, need only grasp a stationary object, and does not need to absorb any of the energy of the object.

Two additional uses for the present invention would be for rehabilitation of disabled or elderly individuals who have limited motor skills and coordination and as a game for such individuals.

The pendulum has long been known, and a number of available toys—such as swings and punching bags—are based on pendulums. However, the properties of the pendulum have not previously been exploited to form a toy that as easily enables a child to catch and controllably throw a ball or to play a hitting game. Furthermore, the pendulum and other hanging toys have inherent safety problems including the hazards of hanging, strangling, choking, and contusions that are solved by the apparatus described in this invention.

SUMMARY OF THE INVENTION

It is an object of the present invention to provide a new and improved toy enabling a child as young as a 4 months old or a disabled individual to catch an object suspended by the pendulum when it comes to momentary zero velocity at each end of its arc.

It is an object of the present invention to provide a new and improved toy with which a child as young as 4 months old or a disabled individual can controllably throw an object simply by releasing it at an elevated position of the pendulum swing or with which older children or those with more motor skill can impart energy to the suspended object by throwing it, batting it by hand, or by using an instrument such as bat or racquet.

It is another object of the present invention to provide new and improved apparatus that minimizes the possibility of a hazard such as choking, hanging, strangling, and contusions.

It is another object of the present invention to provide a method by which a child as young as 4 months old or a disabled individual can play catch.

It is another object of the present invention to provide a method by which a young child or disabled individual can throw and hit.

These and other objects of the invention are accomplished by attaching an object to be thrown and caught to a long supporting member and attaching the other end of said supporting member by means of a pivot to an elevated support structure so that the object and supporting member can oscillate as a pendulum. The object is caught, or thrown near the most elevated position/location of the arc of the pendulum at which the object is moving slowly or is at rest and where it is therefore easiest to catch, hit, or throw.

In the preferred embodiment of the invention, the object is a soft toy, the supporting member is a plurality of plastic rods or beads linked together, and the attaching means is a pivot, which is a plastic ball-in-hole or ball-in-socket in which the ball can be pulled out of the hole or socket with a few pounds of force applied. Soft toys include fabric, leather, rubber, foam, or plastic balls, dolls, stuffed animals, and the like and are widely available. Chains of large plastic beads linked together by a ball in hole are widely used as toys taht infants pull apart or attach together. Alternate embodiments of the supporting member include a long rod, string, leather thong, chain, and the like.

To avoid the hanging hazard, at least one quick-release mechanism is used, so that the supporting member breaks apart or disconnects from the support structure when a sufficient force is applied to the supporting member. The force to activate the quick release mechanism should be less than the weight of the child, as follows: First, there is a possibility that the supporting member will find support at two points and therefore the quick release mechanism should disconnect if a force less than half the weight of the child is applied. Second, there is also a hanging hazard just from the weight of an infants head hanging over a loop or a horizontally supported section. A 3 to 5 month old child typically weights about 14 pounds, of which the head accounts for about half. Thus, the disconnect force should be less than a quarter of the weight of the child, or about 3 pounds or less. 3 pounds is sufficient to hold the weight of a small soft toy and withstand most of the pulling that the infant can apply during play. In the preferred embodiment, the support member is formed of a plurality of linked rods, each link comprising a quick release mechanism, so that the weight of the suspended head would be sufficient to separate the rods no matter how the rods are arranged. Once the excess force is removed, the disconnected rods can then easily be reattached.

For a toy designed for older children or for adults the disconnect force can be correspondingly higher. For example, 2 years old typically weight about 25 to 30 pounds. Also, older children who can stand and walk are able to pull themselves up and so can avoid the hanging hazard just from the weight of the head suspended over a loop or horizontal bar. So for children over 2 years old the disconnect force can be significantly higher but still should be less than half the weight of the child.

To avoid the choking hazard, pieces must all have large enough dimensions to prevent an infant from betting them into the throat. All dimensions must be at least 1.25 and preferably at least 1.67 inches.

To avoid the strangling hazard, the supporting member must be configured so that it cannot be wrapped tightly around the neck. In the preferred embodiment, the ball-in-hole quick release mechanism linking the rods prevents tight wrapping without rod separation.

It is also possible to avoid the above hazards by using a string with sufficiently low tensile pull strength that it breaks when hazardous forces are applied.

The foregoing and other objects, features and advantages of the present invention will be made more apparent from the following description of the preferred embodiments.

BRIEF DESCRIPTION OF THE DRAWINGS

The accompanying drawings illustrate one embodiment of the invention and together with the description serve to explain the principles of the invention.

DETAILED DESCRIPTION OF THE DRAWINGS

Figure 1:
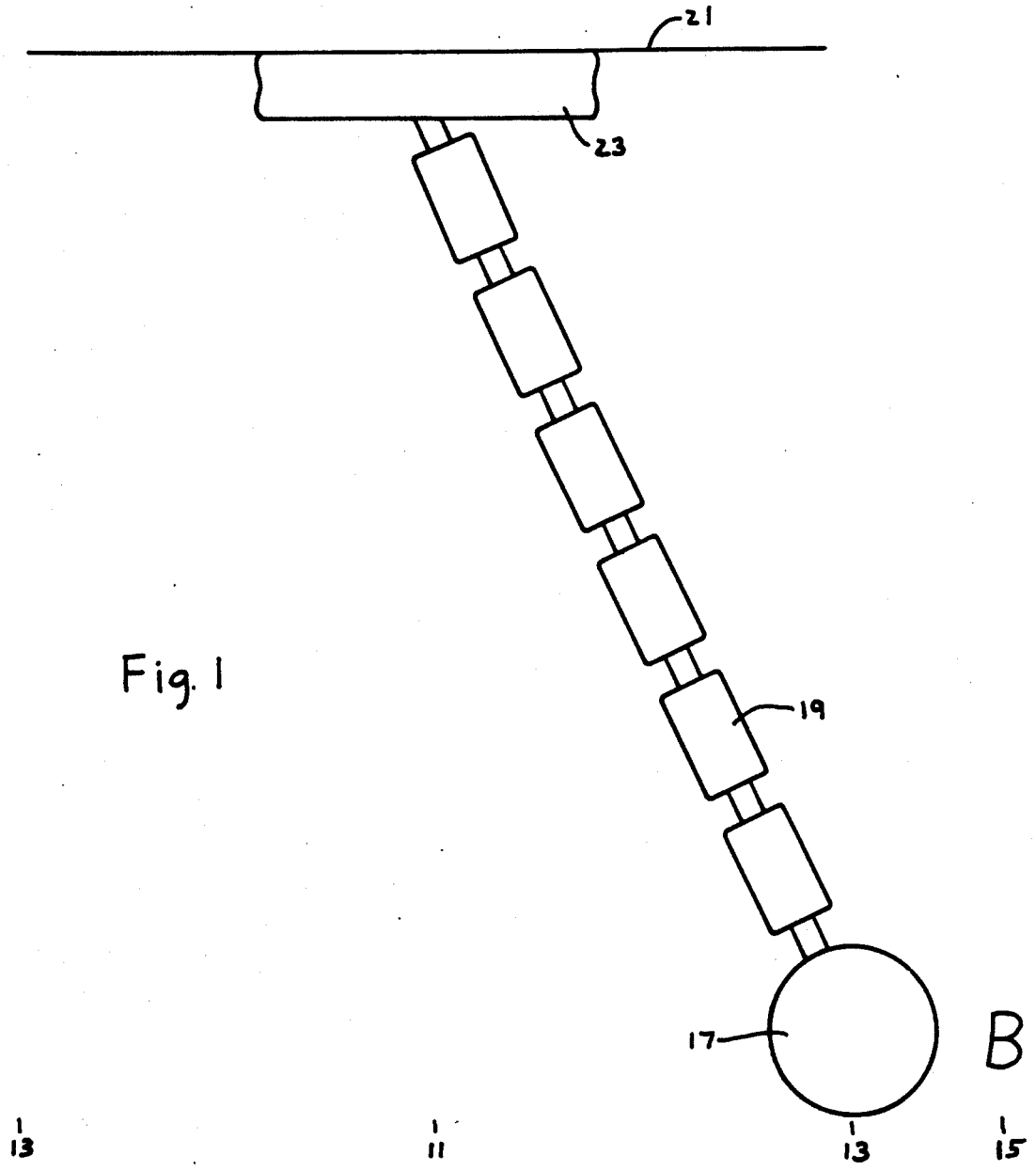
FIG. 1 is a front view, showing the toy constructed in accordance with the present invention and illustrating the position of a baby (by a B) about to catch the object.

Referring to FIG. 1, the object 17 is attached to the supporting member 19, which is attached to a support structure 21. A disconnect means 23 is included between the supporting member and supporting structure. The location of an infant about to catch the object 17 before her is shown by a B.

The velocity of a pendulum varies with position, reaching its maximum at the neutral point 11 (the center or lowest position) and zero at the two ends of the arc 13 where the object 17 is at its highest elevation.

The object 17 may be a ball, doll, rattle, mobile or other toy. The supporting member 19 may be a rod, a chain of rods, a chain of beads, or a string. FIG. 1 illustrates a chain of rods. A disconnect means which causes separation of the supporting member from the support structure when sufficient force is applied prevents the possibility of a hanging accident. The disconnect means may also serve as the attaching means and pivot. It can be a ball-in-hole; sticky tape, including filament tape; or Velcro. The disconnect means may also be located in the supporting member; the chain of rods or chain of beads are able to pull apart from each other if a predetermined force is applied. This feature prevents the possibility of strangling and other hanging hazards. All parts are large enough to prevent an infant from choking or swallowing them. Currently 1.25 inches is specified and 1.67 inches is more preferred as the size of the smallest object for safe use by small infants.

When the object is at the end of its arc 13, it is momentarily at rest. In playing the game, the baby should be located near the point 13 at which the object comes to rest. This can most simply be accomplished by releasing the object from the baby's location 15. It will swing away and return almost to the same position from which it was released. Alternately, the object can be released across the neutral point from the baby from a distance about equal to the baby's distance 15 from the neutral point. The object can also be gently thrown toward the baby with such energy that it comes to rest before her.

Until the baby is old enough to stand on her own, the baby may be seated on the floor or held in another person's arms at a distance 15 from the neutral point of the pendulum's swing which is approximately equal to the arc 13 given to the pendulum. Lesser motor skills, timing, and coordination are needed to catch an object that is part of a pendulum that is momentarily at rest before the baby than are needed to catch a thrown or rolled object without the pendulum.

The baby need only be old enough to grasp which typically can be done at 4 months of age. The baby can catch with only the grasping skill since at the end of its trajectory, the object 17 and rod 19 are moving at zero velocity. The baby need only clasp hands together or clasp the object 17 against his or her mouth or chest to make the catch. Although the baby can still miss the catch if he or she does not keep eyes on the object 17, it is very easy for the baby who can grasp to catch the object 17 attached to the pendulum.

The arc length 13 is not critical since the object 17 will come to rest at the end of each swing for all arc lengths. Furthermore, the time interval for a complete swing of a pendulum is independent of the arc length, depending only on the length of the supporting member. However, if the distance from the neutral point is smaller, the maximum velocity of the object at the neutral point will also be smaller and it may be slightly easier for the infant to watch its motion.

The length of the supporting member is important since the period is proportional to the square root of the length of the pendulum. Thus, a longer supporting member provides more time for each swing, making observation and catching easier. In a preferred embodiment, the pendulum is supported from a ceiling and has a supporting member 5 to 10 feet long.

In using the toy with a young baby, it is important that the baby be positioned at a distance 15 near the end of the arc of the pendulum 13 where the object comes to rest. As the baby is brought closer to the neutral point 11 the object will be moving increasingly faster. As the baby's reactions improve, however, the distance 15 can be reduced compared to the arc length 13. Now the child will be catching an object moving at higher speed. Furthermore, as the child's abilities improve, he or she can bat the object by hand or hold a racquet or bat and impart energy by hitting the object.

Figure 2:
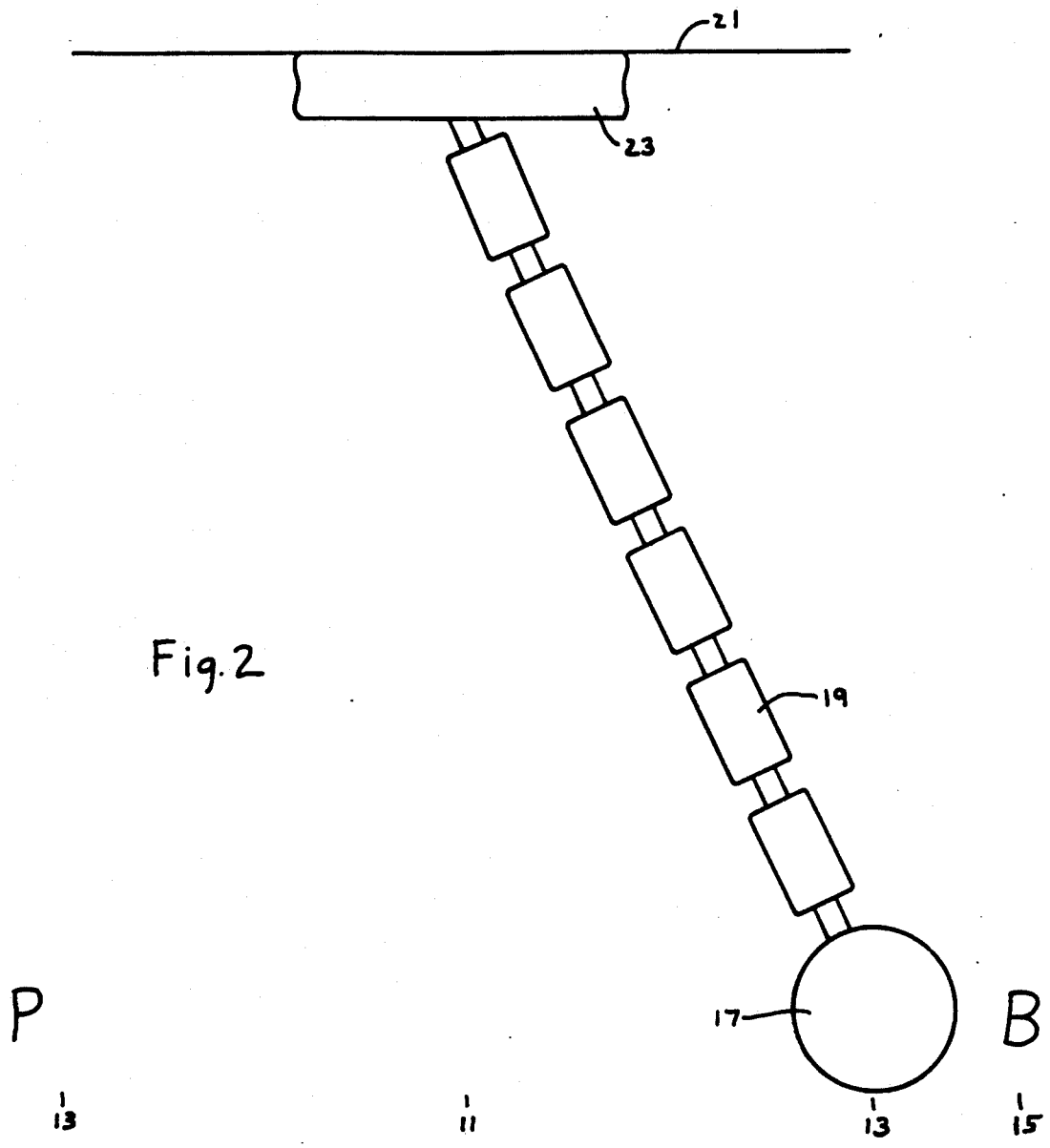
FIG. 2 is a front view, showing the toy constructed in accordance with the present invention and illustrating the position of the baby (B) having just released the object, which will move toward a partner (P).

Referring to FIG. 2, an infant B, has just released or thrown the object 17. Controlled throwing is much easier and well within the motor skills available to an infant using the pendulum toy since the baby can impart energy simply by releasing the object 17 from his or her position along the swing of the pendulum. The object 17 will swing away toward a partner, P, seated opposite the baby, B, or it will continue swinging and return to the baby for another catch. The partner is not needed since the object will come to rest and swing back almost to the baby anyway. Control is built in since the object's path is constrained to the arc of a pendulum. No matter how well energy is imparted, the throw will be a reasonably good one.

The game can also be played with the baby held in the arms of a larger person. Starring with the pendulum at rest at the neutral position, the baby will grasp the toy or rod and the larger person can walk with the baby away from the neutral point of the pendulum. When the baby releases the object, it will swing away and back. At the nearby point where its velocity is zero, the held baby can make the catch.

Figure 3:
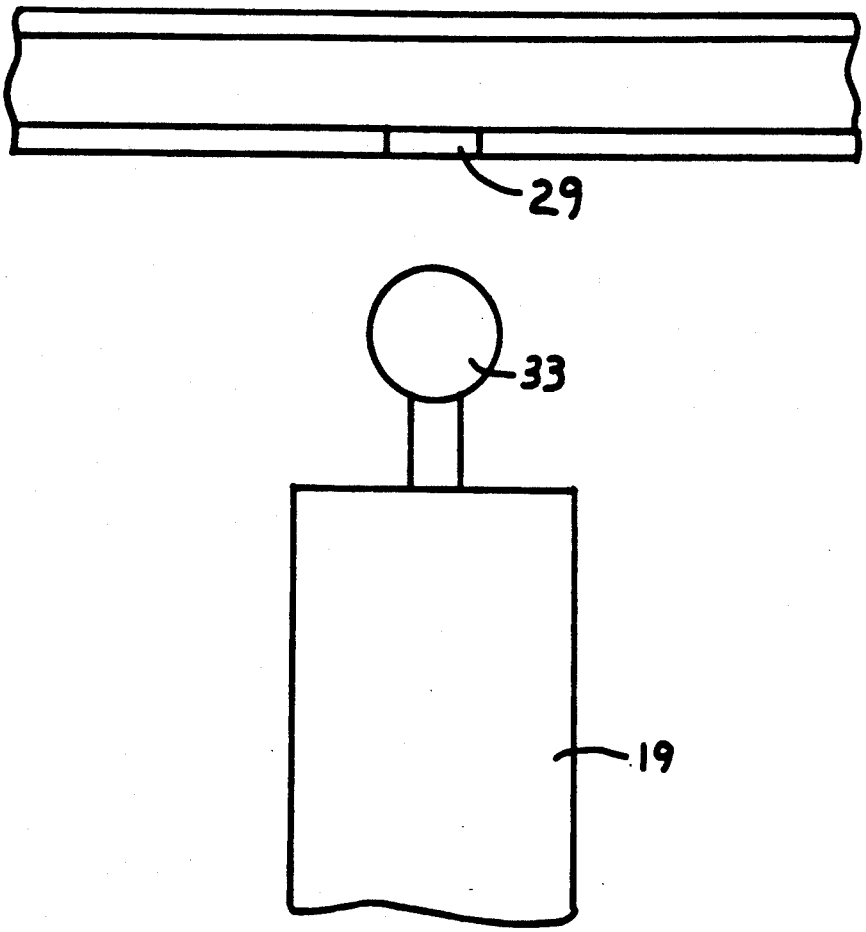
FIG. 3 is a cross-sectional view of the quick-release pivot constructed from a ball-in-socket.

Referring to FIG. 3, a cross sectional view of a device combining the functions of the pivot, disconnect means, and an end of the supporting member 19. In the preferred embodiment, shown in FIG 4, the device is also used between each rod 31 of the chain of linked rods. The ball-in-hole design allows pivoting of the pendulum. While flexing of the joint is necessary to permit pendulum swinging, excess flexing at a single joint tends to pull the ball 33 out of the socket 29. This limits the radius of curvature of the supporting structure, eliminating the possibility of chokingly wrapping the supporting structure around the neck. However, a series of rods and joints can pivot through an angle allowing a full range of pendulum swinging. For deformable materials, such as plastic, dimensions for a ball and a hole can be established providing a maximum force to pull the ball 33 out of the hole 29 and this force can be established anywhere desired in the range from 0.5 to 15 pounds or higher. While the dimensions of the ball may be smaller than 1.25 inches, the ball is so closely connected to the rod which has at least that size, that the ball cannot enter deeply enough into the mouth to provide a choking hazard.

Figure 4:
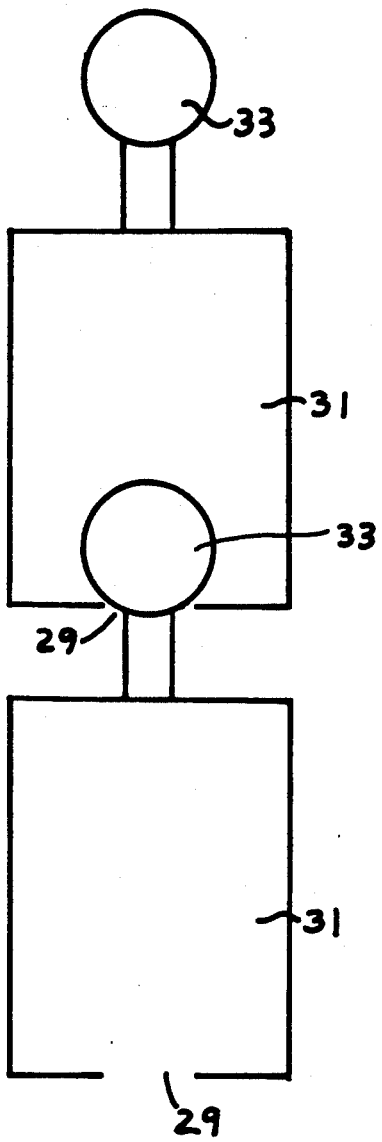
FIG. 4 is a cross-sectional view of two rods out of a chain of rods that would form the supporting member used in the preferred embodiment of the present invention.

Referring to FIG. 4, a cross sectional view of two rods 31, a plurality of which can be used to form the supporting member. In the embodiment shown, the attachment, between rods is a ball 33 at a first end of one rod that is inserted into the hole 29 at a second end of the other rod.

Figure 5:
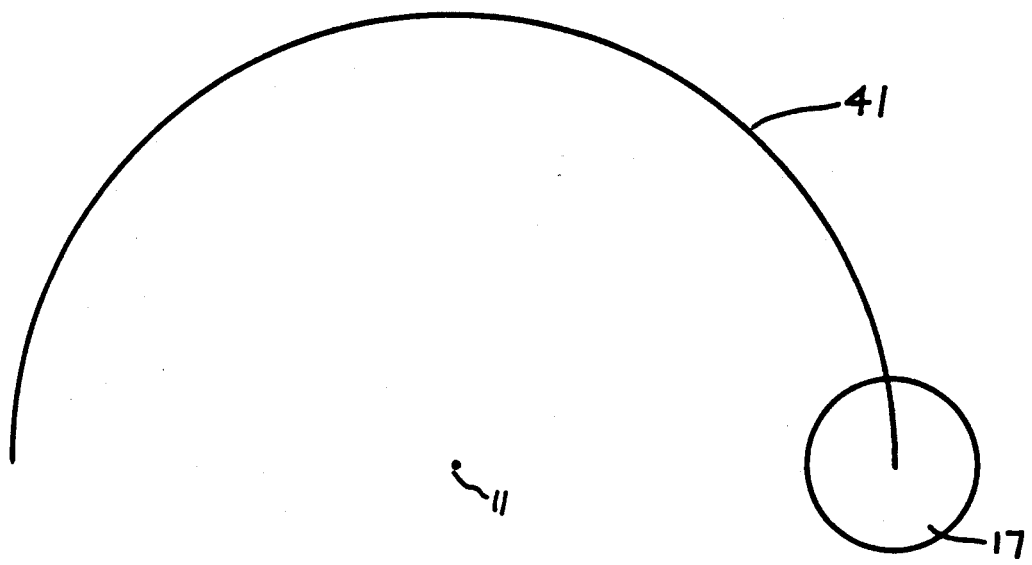
FIG. 5 is a top view showing two-dimensional motion of the pendulum toy.

Referring to FIG. 5, a top view of a two dimensional swing of the pendulum that can be used as the player's skills improve is shown. If energy is imparted to the pendulum in a direction other than along the line to the neutral point, from the top view the pendulum will swing in a two dimensional FIG 41, roughly a circle, ellipse or spiral. The curved motion of the pendulum can be used to add significantly to the players' interest in the toy. One can throw the object 17 in several directions and with several initial velocities to reach a partner by various curved paths. However, the pendulum will not come to rest as it does when its motion takes it through the neutral point.

Figure 6:
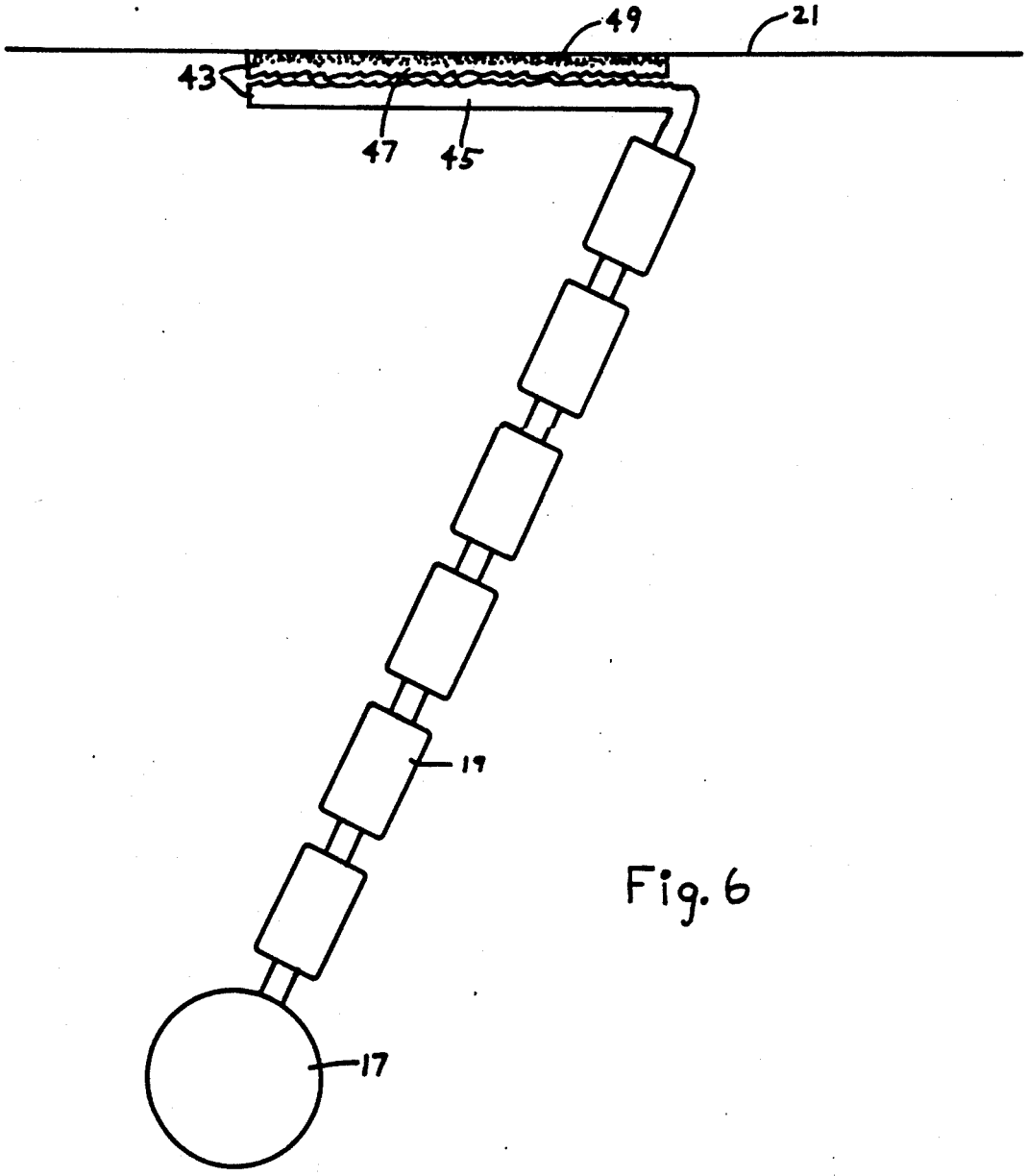
FIG. 6 is a front view, showing the supporting member formed from a chain and attached to a Velcro disconnect means.

Referring to FIG. 6 the supporting member is attached to a Velcro disconnect means 43. Velcro is known in the art, formed from two pads with surfaces that cling to each other and which can be separated with little force when the two pads are peeled apart. It is known that the force needed to peel apart a Velcro pair is determined by factors including the width and material of the pads.

In FIG. 6 the supporting member is attached to an end of one of the pads 45 of a Velcro pair; the other pad 47 of the pair is attached to a support structure 21 by means of sticky tape 49. Velcro with a sticky tape backing is commercially available. The attachment near the end of the Velcro pad allows the Velcro pair to peel apart when a sufficient force is applied to the supporting member 19.

Also illustrated in FIG. 6 is a supporting member 19 formed from a chain.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples for the object, support member, and attaching means are intended only to be illustrative rather than exclusive. Those skilled in the art would find many obvious equivalents to those listed above.

What is claimed is:

1. A pendulum toy, comprising:

a supporting member comprising a plurality of rods linked together;

a disconnect means comprising a ball-in-socket between each of the rods in which the ball-in-socket between two of the rods breaks apart if the force pulling on said supporting member is in the range from about 0.5 to about 15 pounds, said disconnect means easily reconnectable after the excess force is removed;

means for restricting the range of motion of the ball-in-socket in which the ball is pulled out of the socket if the joint is flexed so the curvature of the supporting member is no smaller than the curvature of an infants neck;

an object supported in this manner is a soft toy;

all detachable pieces of the toy have a length at least 1.25 inches to prevent an infant choking accident.

2. A pendulum toy, comprising:

a supporting member comprising a chain;

means to attach for pivotal movement a first end of the supporting member to an elevated support structure;

means to automatically and nondestructively disconnect two links of the chain if the force pulling on the chain exceeds a value in the range from about 0.5 to about 15 pounds;

means to automatically and nondestructively disconnect two links of the chain if the chain is flexed so the curvature of the supporting member is no smaller than the curvature of in infants neck;

said disconnect means reconnectable after the excess force is removed.

3. A toy as recited in claim 2 wherein the pulling force is a value in the range from 3 to 30 pounds.

4. A toy as recited in claim 2 or 3 wherein the object comprises a soft toy.

5. A toy as recited in claim 2 comprising means for automatically and nondestructively disconnecting the first end of the supporting member from the support structure if the force pulling on the supporting member exceeds a value in the range from about 0.5 to about 15 pounds, said disconnect means easily reconnectable after the excess force is removed.

6. A pendulum toy, comprising:

a supporting member comprising a plurality of rods;

means to attach for pivotal movement a first end of the supporting member to an elevated support structure;

a second end of the supporting member supports on a object;

automatic and nondestructive means for disconnecting two rods from each other if the force pulling on the supporting member exceeds a value in the range from about 0.5 to about 15 pounds, said disconnect means easily reconnectable after the excess force is removed.

7. A toy as recited in claim 6 comprising means for automatically disconnecting the first end of the supporting member from the support structure if the force pulling on the supporting member exceeds a value in the range from about 0.5 to about 15 pounds, said disconnect means easily reconnectable after the excess force is removed.

8. A toy as recited in claim 6 wherein the pulling force is in the range from 3 to 30 pounds.

9. A toy as recited in claim 6 or 8 wherein the object comprises a soft toy.

* * * * *